US008410876B2

(12) United States Patent
Heckenkamp et al.

(10) Patent No.: US 8,410,876 B2
(45) Date of Patent: Apr. 2, 2013

(54) ELECTRONIC OVERLOAD RELAY SWITCH ACTUATION

(75) Inventors: Daniel Patrick Heckenkamp, Oconomowoc, WI (US); Matthew Wilbur Naiva, Wauwatosa, WI (US); Thomas Francis Kurland, North Prairie, WI (US)

(73) Assignee: Eaton Corporation, Cleveland, OH (US)

( * ) Notice: Subject to any disclaimer, the term of this patent is extended or adjusted under 35 U.S.C. 154(b) by 77 days.

(21) Appl. No.: 13/165,047

(22) Filed: Jun. 21, 2011

(65) Prior Publication Data

US 2012/0001706 A1 Jan. 5, 2012

Related U.S. Application Data

(60) Provisional application No. 61/360,221, filed on Jun. 30, 2010.

(51) Int. Cl.
*H01H 73/00* (2006.01)
*H01H 75/00* (2006.01)

(52) U.S. Cl. ..... 335/6; 335/11; 335/14; 335/17; 335/27; 335/38; 335/170; 335/186; 335/203

(58) Field of Classification Search ..... 335/6, 8, 335/11, 13, 14, 15, 17, 21, 26, 27, 38, 170, 335/186, 203; 361/23
See application file for complete search history.

(56) References Cited

U.S. PATENT DOCUMENTS

| | | | | |
|---|---|---|---|---|
| 4,520,244 | A | 5/1985 | Forsell et al. | |
| 4,528,539 | A | 7/1985 | Forsell et al. | |
| 4,806,897 | A | 2/1989 | Fajner et al. | |
| 4,891,621 | A | 1/1990 | Heckenkamp et al. | |
| 6,025,766 | A * | 2/2000 | Passow | 335/78 |
| 6,507,255 | B1 | 1/2003 | Simms et al. | |
| 7,460,344 | B2 | 12/2008 | Hastings et al. | |
| 2011/0057750 | A1 * | 3/2011 | Suzuki et al. | 335/20 |

* cited by examiner

*Primary Examiner* — Ramon Barrera
(74) *Attorney, Agent, or Firm* — Eckert Seamans Cherin & Mellott, LLC; David C. Jenkins

(57) ABSTRACT

The disclosed concept provides for an operating mechanism in a overload relay assembly having a solenoid with a permanent magnet. The solenoid includes a ferrous output member. The solenoid moves the output member between a first retracted position and a second extended position. When the output member is in the first retracted position, the permanent magnet maintains the output member in the first retracted position. Thus, in a system wherein the overload relay assembly interrupts power to its own operating mechanism solenoid, the permanent magnet maintains the output member in the first retracted position even when the solenoid is de-energized.

10 Claims, 4 Drawing Sheets

ELECTRONIC OVERLOAD RELAY SWITCH ACTUATION

CROSS REFERENCE TO RELATED APPLICATION

This application claims priority under 35 U.S.C. §119(e) to U.S. Provisional Patent Application Ser. No. 61/360,221, filed Jun. 30, 2010 entitled OVERLOAD RELAY SWITCH WITHOUT SPRINGS. This application is related to commonly assigned, and concurrently filed, U.S. patent application Ser. No. 13/165,001, filed Jun. 21, 2011, entitled "OVERLOAD RELAY SWITCH WITHOUT SPRINGS".

BACKGROUND INFORMATION

Relay switches, such as, but not limited to relay switches on motor starters, are used to interrupt power to a motor in the event of an over current condition. Typically, a power source provides electricity to the motor via a plurality of line conductors. A contactor switch assembly is disposed on the conductors and is structured to interrupt the circuit. That is, the contactor switch assembly has a plurality of switch members structured to move between a first, open configuration, wherein electricity cannot be communicated from the power source to the motor, and a second, closed configuration, wherein electricity is communicated from the power source to the motor. The plurality of switch members are moved between positions by a solenoid. The configuration of the contactor switch assembly is controlled by the relay switch. That is, the contactor switch assembly solenoid receives a command signal from the relay. As long as the command signal is being provided, the contactor switch assembly solenoid maintains the switch members in the second, closed configuration. If the command signal is interrupted, or otherwise not provided, the contactor switch assembly solenoid moves/maintains the switch members in the first, open configuration.

The command signal is generated in the relay switch. That is, the relay switch is structured to detect characteristics of the current in the line conductors and, if no over current condition exists, provide the command signal. Relay switches, typically, have two outputs; the command signal and a reset indicator. Within the relay switch there is a switch assembly with two pairs of electrical terminals and two switch members. When the first pair of electrical terminals are coupled by a switch member, i.e. in electrical communication, the command signal is provided to the contactor switch assembly. When the second pair of electrical terminals are coupled by a switch member, i.e. in electrical communication, an indicator signal is provided to the reset indicator. The switch members are structured to be in opposing configurations. That is, if the first contacts are closed, the second contacts are open and vice versa. Thus, the relay switch is either providing a command signal, and maintaining the contactor switch assembly in the closed configuration, or not providing the command signal, and causing the contactor switch assembly to move to the open configuration, while providing an indication that the relay needs to be reset.

Relay switches, such as, but not limited to, the relay switches disclosed in U.S. Pat. Nos. 4,528,539 and 4,520,244, relied primarily, but not exclusively, on mechanical devices to both detect an over current condition in the line conductors and to move the switch assembly switch members. That is, the device that detected an over-current condition and actuated the relay switch was a mechanical device. The mechanical devices typically relied upon the heat created during an over current condition to cause a bi-metal to warp. The bi-metal was disposed adjacent to, or coupled to, a mechanical link that would move in response to the overheated bi-metal and cause the overload relay assembly switch assembly to open the first pair of electrical terminals. The mechanical link typically acted upon a "snap switch" or "flipper blade." The snap switch was the relay switch conducting switch member. The snap switch included a plurality of features, such as, but not limited to, openings, bends, creases, slits, and/or shaped portions. These features allowed the snap switch conducting member to, essentially, change configuration in response to a manual actuation; i.e. the snap switch conducting member would snap between two configurations. For example, the snap switch could be configured to bend to the right thereby making contact, and electrically engage, the first terminals. Upon actuation, e.g., applying pressure to a selected point on the snap switch, the features cause the snap switch to bend to the left, thereby disconnecting the first terminals. As noted above, opening the first terminal would stop the command signal to the contactor switch assembly and the contactor switch assembly would open. When the contactor switch assembly was open, the current through the relay switch would stop and the bi-metal member would cool. The relay could then be reset. The reset action could, for example, apply pressure to the snap switch causing the snap switch conducting member to return to the configuration wherein the first terminals were in electrical communication.

Resetting the relay was typically accomplished by a reset actuator, typically a button or lever, that extended through the relay housing. When manually actuated, the reset actuator engaged elements to the relay operating mechanism and repositioned those elements for normal operation. This would include moving the overload relay assembly switch assembly to the second configuration wherein the command signal was provided and the contactor switch assembly would close. Thus, resetting the relay would also allow electricity to be provided to the motor. The reset actuator was typically structured to engage various mechanical elements of the relay operating assembly and often had a complex shape. For example, the actuator typically included one or more radial extensions and/or flanges that were structured to engage and move other components within the relay. Further, the reset switch was typically biased to the tripped position (the position the reset actuator was in after an over current condition) by a spring. The complex shape and spring loading of the reset switch added complexity and assembly costs to relay switches.

It is further noted that relay switches could include a test actuator in addition to, or combined with, the reset actuator. The test actuator included additional mechanical links that would cause the relay switch operating mechanism to trip, i.e. cause the overload relay assembly switch assembly to open the first pair of electrical terminals thereby simulating an over current condition. The relay switch could then be reset by the reset actuator or by reversing the actuation of the test actuator. That is, the test actuator typically operated on a pull-to-test, push-to-reset configuration. Like the reset actuator, a test actuator typically had a complex shape and was spring biased.

Further, as noted above, if the relay switch was a snap switch, the snap switch conductive member typically had a complex shape. This shape was required so as to accomplish the "snap" effect required of the snap switch conductive member. Further, the snap switch conductive member may also engage, contact, or otherwise interact with other components of the relay. Thus, the reset actuator, the test actuator, and the relay switch conductive member each had a complex shape. These components were expensive to manufacture and, due to having to place the members in the correct position so as to interact with the other components, were expensive to install.

SUMMARY OF THE INVENTION

The disclosed concept relates to an overload relay assembly that has eliminated many mechanical components including, but not limited to, the spring biased test and reset actuators having a complex shape, the mechanical detection and actuation device, and the complex snap switch conductive member. The disclosed and claimed concept provides for an overload relay assembly that utilizes a current monitoring circuit rather than a mechanical device for detecting an over current condition. The current monitoring circuit includes one or more programmable logic circuits structured to detect an over current condition. The current monitoring circuit provides a first signal when an over current is detected. Due to the elimination of many of the mechanical detection devices which acted upon other mechanical components causing the actuation of the overload relay assembly switch assembly, actuation of the switch assembly is now caused by a solenoid. The solenoid is structured to respond to the first signal indicating an over current condition. The solenoid is coupled to the overload relay assembly switch assembly and is structured to move both the first and second switch members.

Moreover, the test and reset actuators have a reduced complexity. That is, the test and reset actuators are generally straight bodies that are slidably disposed in the relay housing. The test and reset actuators extend partially out of the housing so as to be accessible to a user. More specifically, the test and reset actuators extend partially out of the housing when needed; for the test actuator, this is when the switch assembly is in the second, close position, for the reset actuator, this is after the relay switch has been moved to the first position and needs to be reset. The test and reset actuators are, essentially, elongated members structured to be selectively coupled to one or both of the first and second switch members. For example, a test actuator is selectively coupled to the switch member by an extension that is disposed under the switch member, so that actuating the test actuator lifts the switch member and moves the switch assembly to the open configuration. If the test actuator is pushed, the extension moves away from the switch member and the switch assembly stays if the open, first position. Alternately, the reset actuator selectively engages the switch member, or a component coupled to the switch member, when the switch member is in the open, first position, and moves the switch assembly to the closed, second position. The reset actuator may be disposed substantially within the housing. If so, when the switch member moves following an over current condition, the switch member also moves the reset actuator partially out of the housing where it may be accessed by a user. After the over current condition has been eliminated, the reset actuator is moved into temporary engagement with the switch member, if not already in contact therewith. Further movement of the reset actuator moves the switch member into another position, i.e. the switch member is moved back into the operating position. At this point, the reset actuator may be maintained substantially within the housing as before. When another over-current condition occurs, the movement of the switch member to the first position will move the reset actuator out of the housing so as to be actuated again. Further, movement of the switch assembly to the second position causes the test actuator to move as well. Because these actuators are moved by the movement of the switch members, no spring or other return device is required to reposition the actuators.

Further, the complex snap switch conductive member has been replaced with a simple blade. The blade is an elongated, substantially flat member having a terminal pad adjacent one end. Because the blade does not have the "snap" feature, the blade is much less complex, and less expensive, than the known snap switch conductive member. Further, the blade is simple and inexpensive to install.

It is noted that the use of a solenoid, while being an improvement, creates a disadvantage as well. A solenoid utilizes a coil of conductive wire disposed in a housing and disposed about a movable output member, typically a conductive metal rod. When the coil is energized, the coil acts as an electromagnet and moves the rod between a first position and a second position. That is, when the coil is energized, a magnetic force biases the rod axially in one direction, i.e. from the first position to the second position. Typically, the rod first position is substantially outside of the coil, thus when the coil is energized, the magnetic force draws the rod into the coil, which is typically the second position.

Unless counteracted by a stronger force, the rod will stay in the second position until the coil is de-energized. There are two simple means for returning the rod to the first position; a spring or passing a current with reversed polarity through the coil, hereinafter a "second current". If a spring is used, the solenoid coil must be de-energized so that the magnetic force is eliminated and the bias of the spring may return the rod to its original position. If a second current is used, the magnetic force now biases the rod in the opposite direction, i.e. toward the first position.

In a device structured to interrupt a current and wherein the solenoid is powered via a current passing through the device, these types of solenoids may not provide the functional capabilities that are needed for proper operation of the device. For example, it may be desirable to move a solenoid rod and then hold the rod in that position for a period of time. This is a problem in devices structured to interrupt a circuit wherein the circuit powers the solenoid. That is, generally, if one wanted to selectively control the position of the spring biased solenoid rod, one would merely keep the coil energized until the rod needed to return to its original position, or, a solenoid structured to have currents with different polarities, one would keep the first current energized until the rod needs to return to its original position, whereupon the second current would be energized. In a device that both interrupts the circuit and powers the solenoid, however, the interruption of the circuit de-energizes the coil and/or prevents the second current from being applied. Thus, if a spring biased solenoid is used, the solenoid rod is returned to its first position as soon as the solenoid is de-energized. In a dual coil solenoid, the second current cannot be energized and the solenoid is stuck in the second position.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, a "generally straight" body means an element wherein the body has a substantially constant crosssectional shape and area extending over substantially all of the longitudinal axis of the body. That is, the body does not have a plurality of lateral extensions or cut-outs forming multiple ledges. A "generally straight" body may have a single lateral extension, offset, or flange, but not more than one.

As used herein, "coupled" means a link between two or more elements, whether direct or indirect, so long as a link occurs.

As used herein, "directly coupled" means that two elements are directly in contact with each other.

As used herein, "fixedly coupled" or "fixed" means that two components are coupled so as to move as one while maintaining a constant orientation relative to each other. The fixed components may, or may not, be directly coupled.

As used herein, "selectively coupled" means components are temporarily coupled following a selected action. Typically, the action is a motion in one direction such as, but not limited to, pushing and pulling. For example, a rake head is "selectively coupled" to debris as a user pulls the debris toward a pile. When the user lifts the rake head, or moves the rake head in the opposite direction whereby it no longer engages the debris, the rake head is no longer "selectively coupled" to the debris.

As used herein, the word "unitary" means a component is created as a single piece or unit; that is, a component that includes pieces that are created separately and then coupled together as a unit is not a "unitary" component or body.

As used herein, "low voltage" means a low industrial voltage of about 600 volts.

Figure 1:
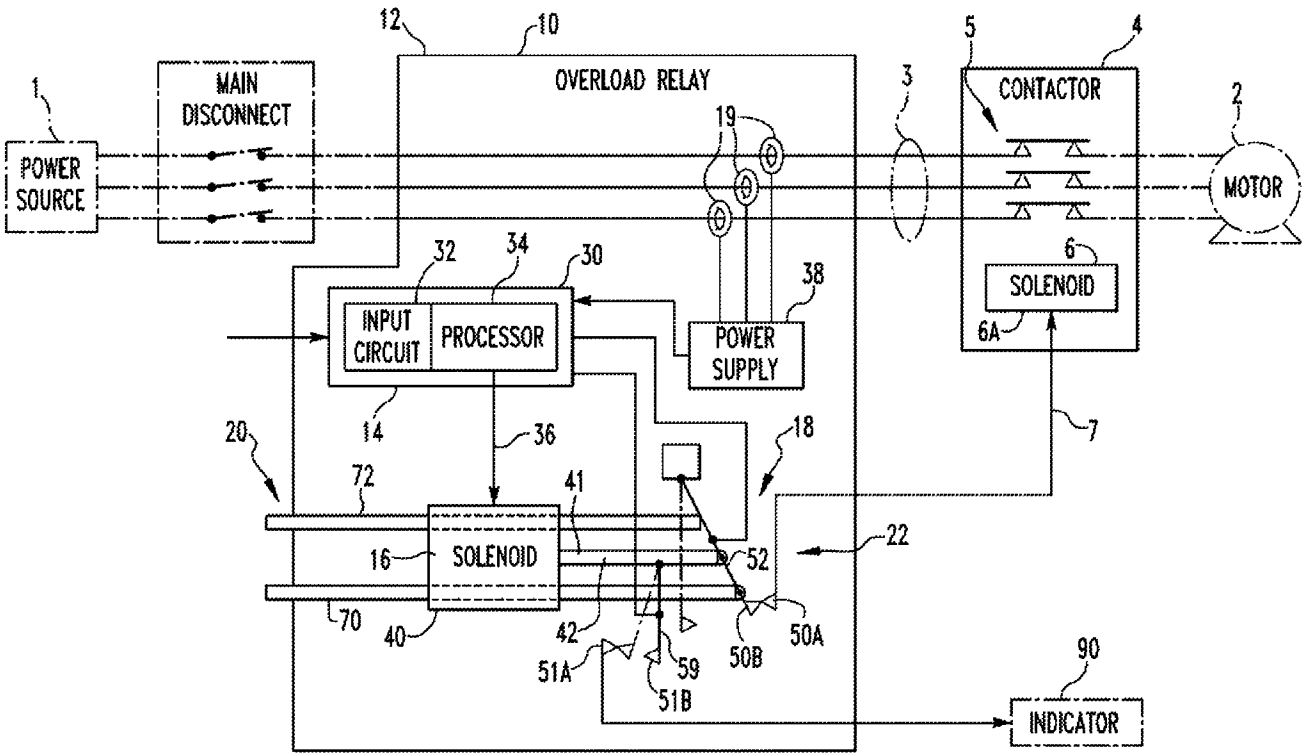
FIG. 1 is a schematic view of a motor starter.

As shown in FIG. 1, overload relay assembly 10 is structured to be disposed between a low voltage power source 1 and a device, typically a motor 2. That is, as used herein, a "motor" is any device powered by the power source 1. The power source 1 and the motor 2 are selectively coupled, and in electric communication, by a plurality of primary line conductors 3. A contactor switch assembly 4 is disposed on the primary line conductors 3. The contactor switch assembly 4 has a plurality of switch members 5 structured to move between a first, open configuration, wherein electricity cannot be communicated from the power source 1 to the motor 2, and a second, closed configuration, wherein electricity is communicated from the power source 1 to the motor 2. The configuration of the contactor switch assembly switch members 5 is controlled by a contact switch actuator 6, such as, but not limited to a solenoid 6A. The contact switch actuator 6 is structured to receive a command signal, represented by line 7. It is noted, the command signal may be, and preferably is, a simple current. That is, the existence of the current is the command signal and the lack of a current is a state of no command signal. The contact switch actuator 6 operates as follows: when the command signal 7 is being received, the contact switch actuator 6 maintains the contactor switch assembly switch members 5 in the second, closed configuration, and, when the command signal 7 is not being received, the contact switch actuator 6 maintains the contactor switch assembly switch members 5 in the first, open configuration.

Figure 2:
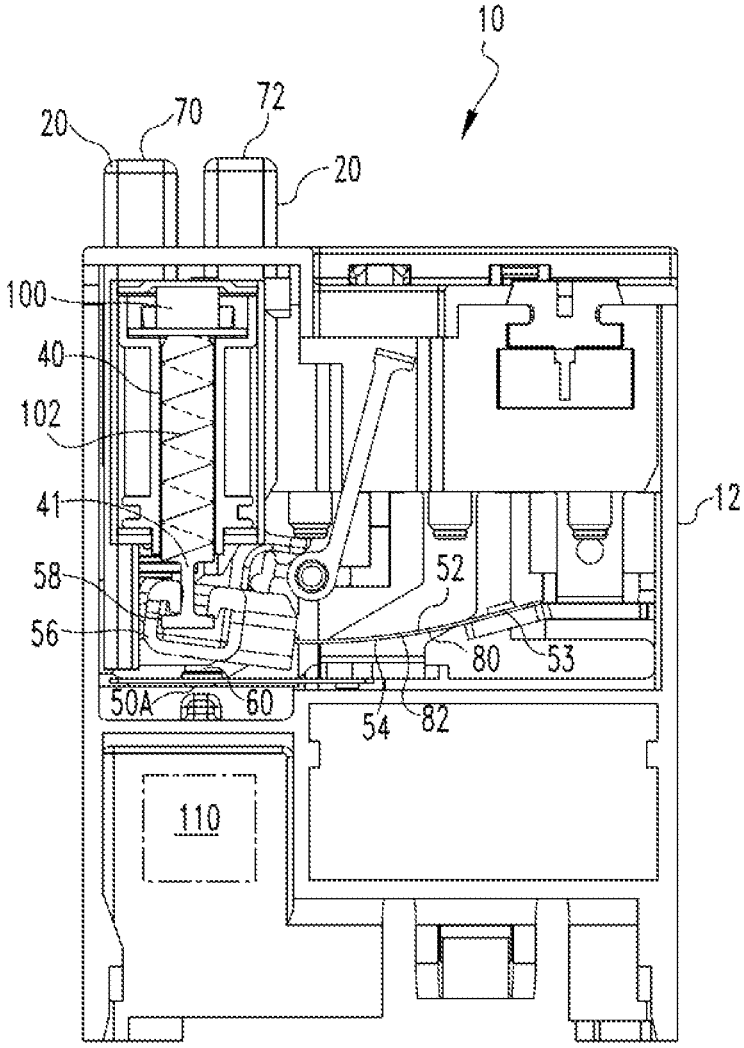
FIG. 2 is a side view of an overload relay.
Figure 3:
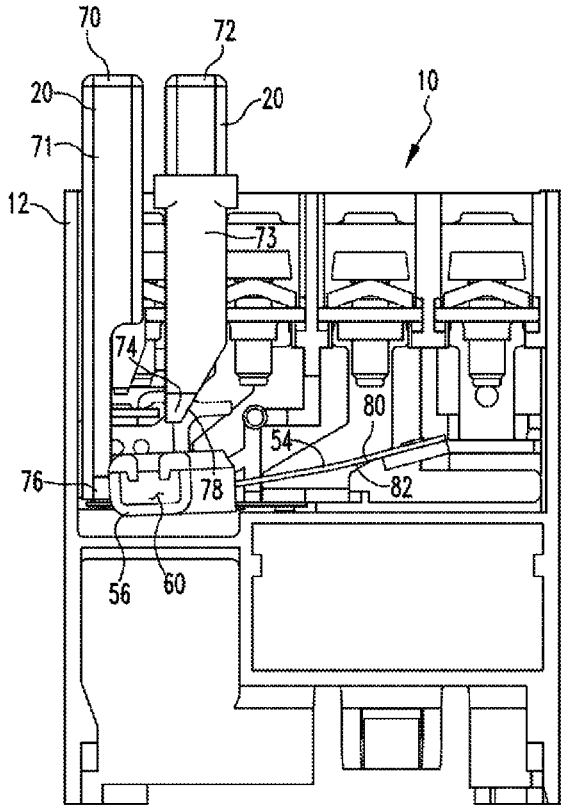
FIG. 3 is a side view of an overload relay.
Figure 4:
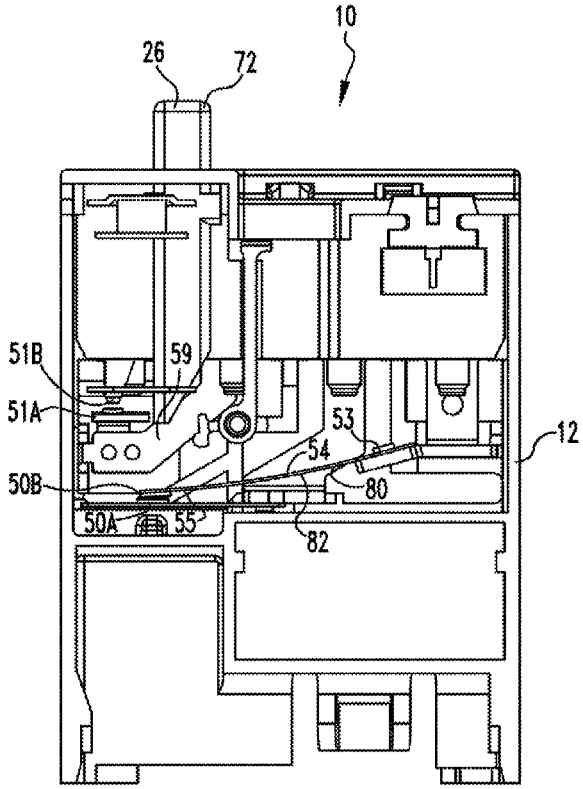
FIG. 4 is a side view of an overload relay.

As shown in FIGS. 2-4, the overload relay assembly 10 includes a housing 12, a current monitoring circuit 14, an actuator 16, at least a first switch assembly 18, and at least one manual actuator 20. The current monitoring circuit 14, the actuator 16, the at least a first switch assembly 18, and the at least one manual actuator 20 comprise an operating mechanism 22 of the overload relay assembly 10. The housing 12 is preferably a non-conductive material defining a substantially enclosed space. The housing 12 may have openings (not shown) for conductors, actuators, etc. to pass therethrough. The current monitoring circuit 14 preferably includes at least one programmable logic circuit 30 (PLC) and may include both an input circuit 32, structured to receive input and convert that input into a signal, and a processor 34, structured to receive and process the input signal and to provide a first signal, represented by line 36.

The current monitoring circuit 14 is structured to detect an over-current condition in any of the plurality of conductors 3 and to provide the first signal 36 in response to an over current condition The current monitoring circuit 14 is disposed in the housing 12. The monitoring circuit 14 includes a leeching power supply 38. The leeching power supply 38 of the overload relay assembly 10 is preferably structured to be parasitically-powered from the line conductors 3. In that instance, the overload relay assembly 10 further includes a number of current transformers 19 structured to sense current flowing to the motor 2 and to supply power to the power supply 38. That is, the leeching power supply 38 draws power from the current flowing to the motor 2. Thus, when the current to the motor 2 is interrupted, the overload relay assembly 10 is no longer powered. The leeching power supply 38 is coupled to, and in electronic communication with, the current monitoring circuit 14. In this configuration, the leeching power supply 38 powers the current monitoring circuit 14 while enabling the current monitoring circuit 14 to monitor the characteristics of the current in the primary line conductors 3.

The actuator 16 includes an output member 42 structured to move between a first position and a second position. Preferably, the actuator 16 is a solenoid 40 having an elongated, cylindrical plunger 41, and more preferably is a solenoid 40 having a permanent magnet structured to maintain the output member 42 in one of two positions. As is known, the solenoid 40 includes a housing 44, a coil 46, and the output member 42, i.e. the plunger 41 . The output member 42 has a body 43 made from a material capable of being influenced or effected by a magnetic field, typically a ferrous material. The coil 46 is disposed in the solenoid housing 44 and defines a passage 48. The output member 42 is movably disposed in the passage 48. More specifically, the output member 42 is structured to move axially within the passage 48. The coil 46 is made of a conductive material that is disposed about, but not coupled to, the output member 42. The coil 46 is structured to be, and is, selectively coupled to, and in electrical communication with, the leeching power supply 38. That is, when the current monitoring circuit 14 detects an over-current condition in any of the plurality of conductors 3, the current monitoring circuit 14 causes the leeching power supply 38 to energize the coil 46. When the coil 46 is energized, the coil acts as an electromagnet and biases the output member into the solenoid housing 44. Thus, the output member 42 is movably disposed within the coil and, more specifically, the output member 42 is structured to move axially when the coil 46 is energized.

The actuator 16 is structured to receive a signal and, more specifically, the actuator 16 is in electrical communication with the current monitoring circuit 14 and structured to receive the first signal 36. Thus, in response to the first signal, the actuator 16 is structured to move between a first position and a second position, e.g. if the actuator is a solenoid 40, the signal energizes the coil 46 (or the signal causes another energized conductor (not shown) to energize the coil 46) thereby moving the output member 42 between the first and second position. That is, as is known, the current monitoring circuit 14 may provide a signal, e.g. a current, to the solenoid 40 to control the position of the output member 42. The actuator 16 is also disposed within the housing 12.

The first switch assembly 18 has at least a first pair of electrical terminals 50A, 50B, (FIGS. 1 and 4) and at least a first movable switch member 52. The first switch assembly first switch member 52 is structured to move between a first open position, wherein the first switch assembly 18 at least first pair electrical terminals 50A, 50B are not in electrical communication, and a second, closed position, wherein the first switch assembly 18 at least first pair electrical terminals 50A, 50B are in electrical communication. Preferably, the first electric terminal 50A is fixed to the housing and the second electric terminal 50B is disposed on the first switch member 52, i.e. the second terminal 50B is a movable terminal. The first switch assembly 18 at least first pair electrical terminals 50A, 50B are in electrical communication with the current monitoring circuit 14. The current monitoring circuit 14 produces the command signal, represented by line 7 noted above. The command signal may be a simple current. That is, the current monitoring circuit 14 outputs a current that is transmitted through the at least a first pair of electrical terminals 50A, 50B.

More specifically, the first terminal 50A is coupled to, and in electrical communication with, the contact switch actuator 6, and, the current monitoring circuit 14 is coupled to, and in electrical communication with, the second terminal 50B. Accordingly, when the first switch member 52 is in the second, closed position, a current, i.e. the command signal 7, passes through the at least first pair electrical terminals 50A, 50B. Thus, when the first switch assembly switch member 52 is in the second, closed position, the command signal is provided to the contact switch actuator 6. The first switch assembly 18 is disposed in the housing 12. The current passing through the first switch assembly 18 when in the closed, second position is drawn from the transformers 19, as noted above.

As shown in FIG. 2, the actuator output member 42 is coupled to the first switch assembly switch member 52. The first movable switch member 52 includes a conductive member 54 and a nonconductive bracket 56. The conductive member 54 has a fixed, proximal end 53 and a movable distal end 55. One electrical terminal 50B is disposed at the conductive member distal end 55. The conductive member 54 is coupled to the nonconductive bracket 56 and moves therewith, preferably at or near the conductive member distal end 55. The bracket 56 preferably includes at least one coupling point 58 including a pocket 60, structured to be coupled to the output member 42. For example, when the actuator 16 is a solenoid 40 having an output member 42, the distal end of the output member 42 is sized to fit within, and pivot within, the pocket 60, as the solenoid 40 is actuated, the output member 42 moves between the first and second position. As the output member 42 is coupled to the bracket 56, the bracket 56 moves. As the conductive member 54 is coupled to the nonconductive bracket 56, the conductive member 54 moves with the bracket 56. Movement of the conductive member 54 moves the first movable switch member 52 between the first open position, wherein the first switch assembly 18 at least first pair electrical terminals 50A, 50B are not in electrical communication, and the second, closed position, wherein the first switch assembly 18 at least first pair electrical terminals 50A, 50B are in electrical communication. Thus, the first movable switch member conductive member 54 is structured to selectively couple the at least first pair of electrical terminals 50A, 50B. In this configuration, when the actuator output member 42 is in the first position, the first switch assembly switch member 52 is in the first, open position, and when the actuator output member 42 is in the second position, the switch assembly first switch member 52 is in the second, closed position.

As shown in FIG. 3, the at least one manual actuator 20 preferably includes a test actuator 70 and a reset actuator 72. Both the test actuator 70 and the reset actuator 72 have elongated, generally straight bodies 71, 73, preferably made from a nonconductive material. The at least one manual actuator 20 is slidably disposed through the housing 12 and is structured to be coupled to the first switch assembly switch member 52 and structured to move the first switch assembly switch member 52. The test actuator 70 and the reset actuator 72 may be offset from the first switch assembly switch member 52 within the housing 12 and each may have a lateral extension 76, 78 (respectively) structured to span the offset. The elongated actuators 70, 72 are, preferably, structured to slide axially. Preferably the test actuator 70 is coupled to the bracket 56 with the lateral extension 76 disposed below the bracket 56, but not attached thereto. In this configuration, the test actuator 70 and the first switch assembly switch member 52 are selectively coupled so that upward movement of the test actuator 70 moves the first switch assembly switch member 52. Thus, moving the test actuator 70 in a first direction moves the first movable switch member 52 into the first position. That is, a user may, for example, pull on the test actuator 70 to cause the first movable switch member 52 to move into the first position. This, in turn, causes the contact switch actuator 6 to move into the first, open configuration. Thus, actuating the test actuator 70 trips the overload relay assembly 10. As discussed below, this will cause the solenoid output member 42 to become magnetically latched in the first position thereby maintaining the first switch assembly 18 in the open, first position. Thus, pushing on the test actuator 70 to causes the test actuator 70 to move away from the bracket 56 as the lateral extension 76 is disposed below the bracket 56.

The reset actuator 72, on the other hand, is structured to selectively couple the first switch assembly switch member 52 from above and move the first switch assembly 18 in the closed, second position. The reset actuator 72 has a distal end 74, which may include the lateral extension 78, disposed within the housing 12. The reset actuator distal end 74 is spaced from the first switch assembly switch member 52 when the first switch assembly switch member 52 is in the second, closed position. When the first switch assembly switch member 52 is in the first, open position, however, the reset actuator distal end 74 engages, or is immediately adjacent, the first switch assembly switch member 52. Preferably, the reset actuator 72 is structured to be selectively coupled to the bracket 56. When the reset actuator 72 is actuated, the reset actuator 72 moves the first switch assembly switch member 52 into the second position. That is, after an over current event or after a test, wherein the first switch assembly switch member 52 is in the first position, and therefore the contact switch actuator 6 is also in the first, open configuration, actuating the reset actuator 72 moves the first switch assembly switch member 52 into the second position. This allows the command signal, represented by line 7, to be transmitted from the current monitoring circuit 14 to the contact switch actuator 6 as described above, whereby the contact switch actuator 6 is also moved into the second, closed configuration.

The housing 12 may also include an indicator 90. The indicator 90, which is preferably a light, has at least a first state and a second state, e.g. not illuminated and illuminated. The indicator 12 is normally in said first state, e.g. not illuminated. The indicator 90 is further structured to receive an indicator signal and change states in response thereto. Further, the first switch assembly at least first pair of electrical terminals 50A, 50B and at least a first movable switch member 52, includes a second pair of electrical terminals 51A, 51B, (FIGS. 1 and 4) and a second movable switch member 53. The first switch assembly second pair of electrical terminals 51A, 51B are structured to be coupled to, and in electrical communication with, the indicator 90. The first switch assembly second switch member 53 is structured to move between a first open position, wherein the first switch assembly second pair electrical terminals 51A, 51B are not in electrical communication, and a second, closed position, wherein the first switch assembly second pair electrical terminals 51A, 51B are in electrical communication. The first switch assembly second pair electrical terminals 51A, 51B are also in electrical communication with the indicator 90 and, when the first switch assembly second switch member 53 is in the second position, structured to provide an indicator signal thereto.

That is, the indicator 90 preferably indicates that the overload relay assembly 10 has been tripped, i.e. exposed to an over current condition wherein the first switch member 52 is in the first position and the contact switch actuator 6 is also in the first, open configuration. As the indicator 90 should not be illuminated when the first switch member 52 is in the second position, i.e. when the contact switch actuator 6 is in the second, closed configuration, the first switch assembly first switch member 52 and the first switch assembly second switch member 53 are always disposed in opposing positions.

It is noted that with these components in this configuration, the at least one manual actuator 20 does not require, and does not include, a spring or any other separate device structured to bias the at least one manual actuator 20 into a position.

It is further noted that the switch assembly conductive member 54 is preferably a "blade." As used herein, a "blade" is an elongated member that is substantially free from openings. Further, a blade is structured to maintain its shape. That is, as used herein, "structured to maintain" a shape means that a component is not structured to transform from one configuration to another configuration, such as the snap switch conducting members, described above, are structured to do. Thus, the switch assembly conductive member 54 is, preferably, a blade 80. The blade 80 has a body 82 made from a ferrous, conductive material. The blade body 82 is, preferably, substantially flat; that is, other than a slight arcing of the entire blade body 82 which is possible when the blade body is supported at both ends and biased to the second position, the blade body 82 is substantially flat. In a less preferred embodiment, the blade 80 has a fixed shape, but includes a bend (not shown) that may be required to allow the blade 80 to move while in the confined overload relay housing 12. The blade 80 further includes a terminal pad 84 disposed adjacent the switch assembly conductive member distal end 55.

As noted above, the solenoid 40 may include a permanent magnet 100. This allows the operating mechanism 22 to maintain the output member 42 in the first position even in the absence of power. As noted above, the output member 42 may be, and preferably is, a ferrous member. The permanent magnet 100 is disposed on, or preferably in, the actuator 16 in a position so that when the output member 42 is in the first position, the output member 42 is biased to the first position. That is, all magnets, permanent magnets or electromagnets, produce a magnetic field. The magnetic field biases ferrous members toward the magnetic field. Such magnetic fields, however, become weaker, i.e. have less effect on ferrous members, with greater distance. The decrease in the effect of the magnetic field increases at a greater rate as the ferrous member moves away from the magnet producing the field. Thus, for the purpose of this disclosure, and as used herein, a magnet has an "effective magnetic field" with a "limited range." An "effective magnetic field" is a field having a sufficient strength to bias the output member 42 towards the actuator 16 within the "limited range." The "effective magnetic field" depends upon the characteristics of the relationship between the magnet and the ferrous output member 42 and, as such, is preferably not identified by exact dimensions and an exact magnetic strength.

For example, a permanent magnet may have weak or strong magnetic field, a ferrous output member 42 may have a limited amount of ferrous matter therein or may be made exclusively of ferrous metal, the ferrous output member 42 may have a certain weight and be oriented to move in a vertical direction or a horizontal direction (thus the weight of the output member 42 may bias the output member 42 downwardly). These factors, and others, determine whether a magnetic field is an "effective magnetic field." So long as the field biases the output member 42 toward the actuator 16, the field is an "effective magnetic field." By way of a comparative example, if the output member 42 is made exclusively of ferrous metal, is lightweight and oriented to move horizontally, the permanent magnet 100 may be a weak magnet and produce an "effective magnetic field." Whereas a permanent magnet 100 in a system having a 50% ferrous output member 42 that is heavy and oriented to move vertically will need to be much stronger to produce an "effective magnetic field." Further, as described below, the output member 42 may also be biased by a spring. If so, the "effective magnetic field" also has the strength to overcome the bias of the spring.

As noted, a magnetic field becomes weaker with distance from the magnet. As such, a magnet's "effective magnetic field" has a "limited range." Again, this is not capable of a single exact measurement as the "limited range" changes with the characteristics to the magnet and output member 42. Generally, however, the magnet is disposed near the output member 42 when the output member is in the second position and the "limited range" is preferably less than about 0.050 inch.

Thus, the operating mechanism 22 includes a switch assembly 18 coupled to, and in electrical communication with, the leeching power supply 38 and the contact switch actuator 6 whereby the command signal may pass through the switch assembly 18. As set forth above, the switch assembly 18 is structured to move between a first open position, wherein the command signal does not pass through the switch assembly, and a second, closed position, wherein the command signal passes through the switch assembly 18. The actuator 16, as noted, has an output member 42 and a permanent magnet 100. The permanent magnet 100 is disposed near the output member 42 when the output member 42 is in the first position. The actuator 16 is coupled to, and in electronic communication with, the current monitoring circuit 14 and is structured to receive the first signal, described above. The output member 42 is structured to move between a first position and a second position. The output member 42 is coupled to the switch assembly 18 and is structured to move the switch assembly 18 between the first and second positions. When the output member 42 is in the first position, the switch assembly 18 is in the first, open position, and when the output member 42 is in the second position, the switch assembly 18 is in the second, closed position. As further noted above, the output member 42 is structured to move from the first position to the second position in response to the actuator 16 receiving the first signal. Thus, the switch assembly 18 is magnetically maintained in the first open position until the output member is moved away from the permanent magnet. More specifically, the permanent magnet 100 produces an effective magnetic field within a limited range and, when the actuator output member is in the first position, the actuator output member 42 is within the limited range of the effective magnetic field. Thus, the magnetic bias on the output member 42 causes the output member 42 to stay in the first position.

As further noted above, the operating mechanism 22 also includes the at least one manual actuator 20, which is preferably the reset actuator 72. The at least one manual actuator 20 has an elongated body 73 movably disposed in the housing 12. The at least one manual actuator 20 is structured to be selectively coupled to the switch assembly 18 when the switch assembly 18 is in the first position, and, when manually actuated, to move the switch assembly to the second position. That is, when a user actuates the reset actuator 72, the reset actuator 72 engages the switch assembly 18, as described above, and moves the movable switch member 52, which in turn moves the output member 42. As the movable switch member 52 is moved toward the second position, the output member 42 moves out of the limited range of the effective magnetic field. Once the output member 42 is out of the limited range of the effective magnetic field, the output member 42 is easily moved into the second position. For example, if the output member 42 is structured to move vertically, once the output member 42 is out of the limited range of the effective magnetic field, the output member 42 may fall into the second position.

As further noted above, the actuator 16 is preferably a solenoid 40 having a housing 44, a coil 46, and the output member 42. The ferrous output member 42 is movably disposed in the passage 48 defined by the coil 46. The coil 46 is structured to be selectively coupled to the leeching power source 38, as described above. The solenoid coil 46, when energized, produces an electromagnetic field of sufficient strength to bias the output member 42 toward the coil 46. Thus, the ferrous output member 42 is structured to move between an extended second position, wherein the ferrous output member 42 extends substantially out of the solenoid housing 44, and a retracted first position, wherein the ferrous output member 42 is disposed substantially within the solenoid housing 44. The permanent magnet 100 is disposed in the solenoid housing 44 adjacent the passage 48. in this configuration, when the ferrous output member 42 is in the first position, the ferrous output member 42 is in the limited range of the effective magnetic field. Thus, the output member 42 will remain biased toward the first position due to the effective magnetic field. It is noted that the output member 42 will be in the effective range of the permanent magnet 100 when the ferrous output member 42 directly contacts the permanent magnet 100.

In an alternate embodiment, the solenoid 40 may, as is known, include a return spring 102 structured to bias the ferrous output member 42 from the first position to the second position. In this configuration, within the effective magnetic field's limited range, the effective magnetic field produces a force greater than the return spring bias. That is, the magnetic bias from the permanent magnet 100 is sufficient to overcome the return spring 102 bias as well as any other forces acting on the output member 42. Thus, even with the return spring 102, the output member 42 is maintained in the first position until manually moved by the manual actuator 20.

In another alternate embodiment, the operating mechanism 22 may include a reset power source 110. The reset power source 110 may be, but is not limited to, a capacitor structured to be charged while energy is flowing through the primary line conductors 3 and structured to store enough energy to actuate the solenoid 40 at least once. That is, the reset power source 110 is coupled to, and in electronic communication with, the solenoid coil 44, and is structured to energize the coil 44 even when the contactor switch assembly 4 has interrupted the current in the primary line conductor 3, i.e., when the leeching power supply 38 is de-energized. More specifically, the reset power source 110 produces a current having a polarity opposite the current that draws the output member 42. Such a current causes the output member 42 to move out of the solenoid housing 44 toward the second position. More specifically, the reset power source 110 is structured to energize the coil 46 so as to produce an electromagnetic field sufficient to overcome the bias of the effective magnetic field and to move the ferrous output member 42 from the first position to the second position. The reset power source 110 may be remotely operated thereby allowing the overload relay assembly 10 to be reset remotely.

The two alternative embodiments may be combined. That is, the solenoid 40 may include the return spring 102 and be coupled to reset power source 110. In this embodiment, the combined electromagnetic field and the effective magnetic field produce a force on the output member 42 that is greater than the bias of the return spring 102. Further, the return spring 102 bias is stronger than the effective magnetic field. In this configuration, when the solenoid coil 46 is de-energized, the return spring 102 bias overcomes the bias of the effective magnetic field on the output member 42, and the return spring 102 biases the output member 42 to the second position which, in turn, returns the switch assembly 18 to the second position allowing the command signal to be provided to the contactor switch assembly 4. As before, the reset power source 110 may be remotely operated thereby allowing the overload relay assembly 10 to be reset remotely.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An operating mechanism for an overload relay assembly, said overload relay assembly structured to be disposed between a low voltage power source and a motor, said power source and said motor selectively coupled, and in electric communication, by a plurality of electrical primary line conductors, a contactor switch assembly disposed on said primary line conductors, said contactor switch assembly having a plurality of switch members structured to move between a first, open configuration, wherein electricity cannot be communicated from said power source to said motor, and a second, closed configuration, wherein electricity is communicated from said power source to said motor, said contactor switch assembly switch members configuration controlled by a contact switch actuator, said contact switch actuator structured to receive a command signal, wherein, when said command signal is being received, said contact switch actuator maintains said contactor switch assembly switch members in said second, closed configuration, and, when said command signal is not being received, said contact switch actuator maintains said contactor switch assembly switch members in said first, open configuration, said overload relay including a housing defining an enclosed space, a leeching power supply, said leeching power supply coupled to said primary electrical conductors, and a current monitoring circuit structured to detect an over-current condition in any of said primary electrical conductors and to provide a first signal when an over-current condition exists and structured to produce said command signal, said operating mechanism comprising:

a switch assembly coupled to, and in electrical communication with, said current monitoring circuit and said contact switch actuator, whereby said command signal may pass through said switch assembly, said switch assembly structured to move between a first open position, wherein said command signal does not pass through said switch assembly, and a second, closed position, wherein said command signal passes through said switch assembly;

an actuator having an output member and a permanent magnet, said actuator coupled to, and in electronic communication with, said current monitoring circuit and structured to receive said first signal, said permanent magnet disposed near said output member;

said actuator output member structured to move between a first position and a second position, said actuator output member coupled to said switch assembly and structured to move said switch assembly between said first and second positions, and wherein, when said actuator output member is in said first position, said switch assembly is in said first, open position, and when said actuator output member is in said second position, said switch assembly is in said second, closed position, said actuator output member structured to move from said first position to said second position in response to said actuator receiving said first signal;

whereby said switch assembly is magnetically maintained in said first open position until said output member is moved away from said permanent magnet;

said permanent magnet produces an effective magnetic field within a limited range;

wherein, when said actuator output member is in said first position, said actuator output member is within said limited range of said effective magnetic field;

at least one manual actuator, said at least one manual actuator having an elongated body movably disposed in said housing, said at least one manual actuator structured to be selectively coupled to said switch assembly when said switch assembly is in said first position, and, when manually actuated, to move said switch assembly to said second position;

said actuator is a solenoid having a housing, a coil, and an ferrous output member;

said coil structured to be selectively coupled to, and in electrical communication with, said leeching power source, said coil further defining a passage;

said ferrous output member movably disposed in said passage;

said ferrous output member structured to move between an extended second position, wherein said ferrous output member extends substantially out of said solenoid housing, and a retracted first position, wherein said ferrous output member is disposed substantially within said solenoid housing; and said permanent magnet disposed in said solenoid housing adjacent said passage, whereby, when said ferrous output member is in said first position, said ferrous output member is in said limited range of said effective magnetic field.

2. The operating mechanism of claim 1 wherein, when said ferrous output member is in said first position, said ferrous output member directly contacts said permanent magnet.

3. The operating mechanism of claim 2 wherein:

said solenoid further includes a return spring, said return spring structured to bias said ferrous output member from said first position to said second position; and wherein within said effective magnetic field's limited range, said effective magnetic field produces a force greater than said return spring bias.

4. The operating mechanism of claim 2 further including:

a reset power source, said reset power source coupled to, and in electronic communication with, said solenoid coil;

wherein, said solenoid coil, when energized, produces an electromagnetic field; and said reset power source structured to energize said coil so as to produce an electromagnetic field sufficient to overcome the bias of said effective magnetic field and to move said ferrous output member from said first position to said second position.

5. The operating mechanism of claim 2 further including:

a reset power source, said reset power source coupled to, and in electronic communication with, said solenoid coil;

wherein, said solenoid coil, when energized, produces an electromagnetic field;

said solenoid further includes a return spring, said return spring structured to bias said ferrous output member from said first position to said second position;

wherein the combined electromagnetic field and said effective magnetic field produce a force greater than said return spring bias, but said return spring bias being stronger than said effective magnetic field; and whereby, when said solenoid coil is de-energized, said return spring bias overcomes the bias of said effective magnetic field.

6. An overload relay assembly said overload relay assembly structured to be disposed between a low voltage power source and a motor, said power source and said motor selectively coupled, and in electric communication, by a plurality of electrical primary line conductors, a contactor switch assembly disposed on said primary line conductors, said contactor switch assembly having a plurality of switch members structured to move between a first, open configuration, wherein electricity cannot be communicated from said power source to said motor, and a second, closed configuration, wherein electricity is communicated from said power source to said motor, said contactor switch assembly switch members configuration controlled by a contact switch actuator, said contact switch actuator structured to receive a command signal, wherein, when said command signal is being received, said contact switch actuator maintains said contactor switch assembly switch members in said second, closed configuration, and, when said command signal is not being received, said contact switch actuator maintains said contactor switch assembly switch members in said first, open configuration, said overload relay comprising:

a housing, a leeching power supply, a current monitoring circuit, and an operating mechanism;

said housing defining an enclosed space;

said current monitoring circuit structured to detect an over-current condition in any of said primary electrical conductors and to provide a first signal when an over-current condition exists and structured to produce said command signal;

said leeching power supply coupled to said monitoring circuit;

said operating mechanism including a switch assembly and an actuator;

said switch assembly coupled to, and in electrical communication with, said current monitoring circuit and said contact switch actuator, whereby said command signal may pass through said switch assembly, said switch assembly structured to move between a first open position, wherein said command signal does not pass through said switch assembly, and a second, closed position, wherein said command signal passes through said switch assembly;

said actuator having an output member and a permanent magnet, said actuator coupled to, and in electronic communication with, said current monitoring circuit and structured to receive said first signal, said permanent magnet disposed near said output member;

said actuator output member structured to move between a first position and a second position, said actuator output member coupled to said switch assembly and structured to move said switch assembly between said first and second positions, and wherein, when said actuator output member is in said first position, said switch assembly is in said first, open position, and when said actuator output member is in said second position, said switch assembly is in said second, closed position, said actuator output member structured to move from said first position to said second position in response to said actuator receiving said first signal;

whereby said switch assembly is magnetically maintained in said first open position until said output member is moved away from said permanent magnet;

said permanent magnet produces an effective magnetic field within a limited range;

wherein, when said actuator output member is in said first position. said actuator output member is within said limited range of said effective magnetic field;

at least one manual actuator, said at least one manual actuator having an elongated both movably disposed in said housing, said at least one manual actuator structured to be selectively coupled to said switch assembly when said switch assembly is in said first position, and, when manually actuated, to move said switch assembly to said second position;

said actuator is a solenoid having a housing, a coil, and an ferrous output member;

said coil structured to be selectively coupled to, and in electrical communication with, said leeching power source, said coil further defining a passage;

said ferrous output member movably disposed in said passage;

said ferrous output member structured to move between an extended first position, wherein said ferrous output member extends substantially out of said solenoid housing, and a retracted second position, wherein said ferrous output member is disposed substantially within said solenoid housing; and said permanent magnet disposed in said solenoid housing adjacent said passage, whereby, when said ferrous output member is in said first position, said ferrous output member is in said limited range of said effective magnetic field.

7. The overload relay assembly of claim 6 wherein, when said ferrous output member is in said first position, said ferrous output member directly contacts said permanent magnet.

8. The overload relay assembly of claim 7 wherein:

said solenoid further includes a return spring, said return spring structured to bias said ferrous output member from said first position to said second position; and wherein within said effective magnetic field's limited range, said effective magnetic field produces a force greater than said return spring bias.

9. The overload relay assembly of claim 7 further including:

a reset power source, said reset power source coupled to, and in electronic communication with, said solenoid coil;

wherein, said solenoid coil, when energized, produces an electromagnetic field; and said reset power source structured to energize said coil so as to produce an electromagnetic field sufficient to overcome the bias of said effective magnetic field and to move said ferrous output member from said first position to said second position.

10. The overload relay assembly of claim 7 further including:

a reset power source, said reset power source coupled to, and in electronic communication with, said solenoid coil;

wherein, said solenoid coil, when energized, produces an electromagnetic field;

said solenoid further includes a return spring, said return spring structured to bias said ferrous output member from said first position to said second position;

wherein the combined electromagnetic field and said effective magnetic field produce a force greater than said return spring bias, but said return spring bias being stronger than said effective magnetic field; and whereby, when said solenoid coil is de-energized, said return spring bias overcomes the bias of said effective magnetic field.

* * * * *